United States Patent [19]

Wilson

[11] Patent Number: 4,609,158

[45] Date of Patent: Sep. 2, 1986

[54] COMPOSITE GRINDING MILL LINER

[75] Inventor: Clive J. Wilson, Scottsdale, Ariz.

[73] Assignee: Midland-Ross Corporation, Cleveland, Ohio

[21] Appl. No.: 600,534

[22] Filed: Apr. 16, 1984

[51] Int. Cl.[4] ..... B02C 17/22

[52] U.S. Cl. ..... 241/300; 241/182

[58] Field of Search ..... 241/299, 300, 182, 183, 241/284, DIG. 30; 51/164.1

[56] References Cited

U.S. PATENT DOCUMENTS

| | | | |
|---|---|---|---|
| 887,575 | 5/1908 | Barry . | |
| 1,055,395 | 3/1913 | Globe . | |
| 1,128,901 | 2/1915 | Posselt . | |
| 1,295,289 | 2/1919 | Fasting . | |
| 1,315,025 | 9/1919 | Lawler . | |
| 1,470,420 | 10/1923 | Askin et al. . | |
| 1,534,000 | 4/1925 | Baker . | |
| 1,807,034 | 5/1931 | Hardinge . | |
| 1,872,036 | 8/1932 | Hardinge . | |
| 2,216,784 | 10/1940 | Payne . | |
| 2,611,546 | 9/1952 | Posselt | 241/300 X |
| 3,065,920 | 11/1962 | Johnson et al. . | |
| 3,404,846 | 10/1968 | MacPherson et al. . | |
| 3,462,090 | 8/1969 | Landes et al. . | |
| 3,582,007 | 6/1971 | Heighberger . | |
| 3,630,459 | 12/1971 | Slegten . | |
| 3,680,799 | 8/1972 | Hallerback . | |
| 3,701,487 | 10/1972 | Quesnel et al. . | |
| 3,804,346 | 4/1974 | Norman . | |
| 3,949,943 | 4/1976 | Schuler et al. . | |
| 4,018,393 | 4/1977 | Larsen . | |
| 4,046,326 | 9/1977 | Larsen | 241/299 X |
| 4,165,041 | 8/1979 | Larsen . | |
| 4,270,705 | 6/1981 | Larsen . | |
| 4,295,615 | 10/1981 | Mishek . | |
| 4,424,938 | 1/1984 | Day | 241/299 X |

FOREIGN PATENT DOCUMENTS

| | | |
|---|---|---|
| 1131489 | 6/1962 | Fed. Rep. of Germany . |
| 2305311 | 8/1974 | Fed. Rep. of Germany . |
| 474388 | 7/1967 | Japan . |

*Primary Examiner*—Mark Rosenbaum

[57] ABSTRACT

A liner assembly for the interior shell of a grinding mill includes a holder segment having first and second ends and a first surface adapted for mounting engagement with the inner surface of the shell. A second surface of the holder segment faces into the shell and is provided with a longitudinally extending channel. A wear insert and a wedge member are adapted to be retained in the holder segment channel. The wedge member cooperates with two longitudinally extending walls of the holder segment channel to wedgingly engage the wear insert in the channel. Fasteners pass through holder segment mounting apertures to fasten the holder segment to the shell.

10 Claims, 5 Drawing Figures

COMPOSITE GRINDING MILL LINER

BACKGROUND OF THE INVENTION

This invention generally pertains to apparatus for grinding or comminuting and the like. More specifically, the invention relates to a liner assembly for the interior shell of a grinding mill.

Grinding mills are used for the purpose of reducing the size of lumps or other pieces of ore and the like. In the case of ore, the normal function of the grinding mill is to reduce the size of the ore to particles within a fine sieve range for flotation in which, through the use of suitable additives, the ore bearing particles are separated from the gangue. Grinding mills of this type may employ rods or balls to assist in the comminuting process as the mill is rotated. In addition to balls or rods which are generally made of alloy steels, pebbles or natural rock have also been used as grinding media. Such grinding mills typically are comprised of cylindrical shell arrangements rotated about their longitudinal axes, and wherein the shells are closed on the opposite ends thereof. Different diameters and lengths of shells have been utilized heretofore, and they normally vary in proportion to the capacity of the mill.

In modern, large automatic mills the ore may be self grinding. An example of this type of mill comprises a large cylindrical drum mounted on bearings for rotation about its longitudinal axis, and wherein the drum is driven by a motor through conventional reduction gearing. The axial ends of the drum may be open, and the material to be comminuted can be continuously fed into the mill at one end with the comminuted product continuously emerging from the other end.

In view of the basic character of the material being ground, the wear on the inside of the grinding mill has been a serious problem. Normally, grinding mills have been lined with cast or wrought abrasion resistant ferrous alloy liners several inches thick, or in some cases, with rubber or ceramic liners. These liners are segmented due to weight and size considerations. That is, the liner assemblies comprise a plurality of separate components which are usually retained tightly against the interior of the mill shell by mechanical fastening means. During service, the liners tend to be worn easily by the abrasive action of the grinding media and the ore being ground in the mill.

The cost of periodic replacement of liners represents a major item of expense in the operation of mills or plants which grind ore or other minerals. In addition, it is evident that maintaining an ore grinding mill in operation as continuously as possible and keeping downtime for maintenance or repair to a minimum has economic benefits. However, many ores, e.g. taconite, are extremely hard and highly abrasive, and in order to maintain continuous operation of the grinding mill, it is necessary to provide a liner for the drum which is highly abrasion resistant. The liner also should be tough enough to withstand the continuous impact of ore fragments.

Liner segments which are formed with wear insert sockets having a special shape are known in the art. These linear segments are retained within a cylindrical grinder shell by threaded fasteners having heads received in the sockets and shanks passing through both the segments and shell to receive nuts at the shell outer surface. In this type of liner segment, the sockets and heads are shaped to provide continuous flat contact areas of substantial size, regardless of variations in center distances of holes disposed axially along the shell. One difficulty with this type of liner segment is that the structural configuration involved is unnecessarily complex. Another difficulty resides in the fact that the wear inserts provided in the liner segment sockets do not extend over the entire length of the liner, but rather, are discontinuously spaced therealong. Similar problems exist with a type of insert in which the harder material is poured into a "pre-made" casting. Another problem with some types of liner segments is that an unnecessarily complex securing assembly is required to affix the liner to the shell.

The use of hardened wear inserts substantially increases the life of the liner assembly, and as a result, reduces the downtime encountered with previous liner assemblies. A hardened insert in a softer material also maintains a higher lifting surface rather than flattening over the entire surface, thus promoting greater agitation of the rod or ball charge. However, the changing of the known types of liner assemblies remains an arduous task and a substantial number of man-hours is required. This is due primarily to the manner of connecting the known liner segments to the shell. The problem is compounded by the substantial size and weight of each liner segment, and the damage incurred by the segments and connecting bolts from the continuous impact of ore fragments during the comminution process.

It would, therefore, be desirable to have an improved liner assembly for ore grinding mills which is easily replaceable. At the same time, such assembly should preserve the substantial benefit derived from the use of abrasion resistant wear inserts. It would, moreover, be desirable to have a liner assembly in which the wear insert is securely wedged in place in a holder segment. It would also be desirable to provide interlocking ribs and recesses in the holder segments, the wear inserts, and the wedging members for preventing lengthwise movement by either the wedging member or the wear insert with respect to the holder segment.

The subject invention overcomes the above noted difficulties and others, and is deemed to meet the foregoing desirable design parameters.

BRIEF SUMMARY OF THE INVENTION

In accordance with the present invention, a new and improved liner assembly is provided which can be used in all the types of ore grinding mills commonly employed in commercial mining operations.

More particularly in accordance with the invention, the liner assembly includes a holder segment having first and second ends with the segment having a first surface adapted for mounting engagement with the inner surface of a grinding mill shell. The segment has a second surface facing into the shell including a longitudinal channel disposed therein, and a plurality of mounting apertures extend through the segment. A wear insert and a wedge member adapted to be retained in the holder segment channel are also provided. The wedge member is adapted to hold the wear insert in wedging relationship in the channel, and fastening means are provided for fastening the holder segment to the shell.

According to another aspect of the invention, one of the holder segment and wedge member is provided with a plurality of transverse ribs, and the other component is provided with corresponding recesses to restrain the wedge member against longitudinal movement in the holder segment. Preferably, one of the holder segment and wedge member is also provided with an outwardly extending annular portion or boss surrounding each of a plurality of mounting apertures. The annular portions or bosses extend into respective mounting apertures in the other component to secure the wedge member and holder segment against relative movement.

According to a further aspect of the invention, the wear insert and wedge members are provided with tapered longitudinal walls. Such arrangement allows a wedging action to be exerted on the wear insert through cooperation of the wedge member with the longitudinal walls of the holder segment channel.

In accordance with a still further aspect of the invention, the shell defines an inner cylindrical surface in which a plurality of liner assemblies and, hence, a plurality of wear inserts are mounted to the inner shell surface in axial rows. Preferably, the liner assemblies are also mounted to the inner shell surface in circumferential rows.

According to still another aspect of the invention, the wear insert is formed of a material which has a greater resistance to abrasion than the material of the holder and wedge segments. Preferably, the wear insert is formed from martensitic white iron. Also, the holder segment is formed from a material which has a better impact resistance than the material of the wear insert.

According to yet a further aspect of the invention, a plurality of holder segments are arranged in axial rows, and the holder segments, with wear inserts retained therein, are configured to define axially extending elevated ridges.

In accordance with yet another aspect of the invention, a second wear insert can be provided in the holder segment channel. Each wear insert is positioned against a respective longitudinal wall of the holder segment channel and the wedge member is positioned between the two wear inserts to wedgingly hold both inserts in place.

The principal advantage of the present invention is the provision of a new liner assembly for a grinding mill which is easily replaceable while at the same time preserves the substantial benefit derived from the use of abrasion resistant inserts.

Another advantage of the invention is the provision of such a liner assembly in which a wedging action can be exerted on a wear insert by the cooperation of a wedge member and a holder segment for holding the wear insert in place.

A further advantage of the invention is the provision of a plurality of transverse ribs in the holder segments and a plurality of corresponding recesses in the wedge members, as well as outwardly extending annular portions in the wedge members, for restraining the wedge members against longitudinal movement with respect to the holder segments.

Still another advantage of the invention is the provision of a plurality of transverse ribs in the holder segments and corresponding recesses in the wear inserts for restraining the wear inserts against longitudinal movement with respect to the holder segments.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, preferred and alternative embodiments of which will be described in detail in this specification and illustrated in the accompanying drawings which form a part hereof and wherein.

DETAILED DESCRIPTION OF THE PREFERRED EMBODIMENTS

Figure 1:
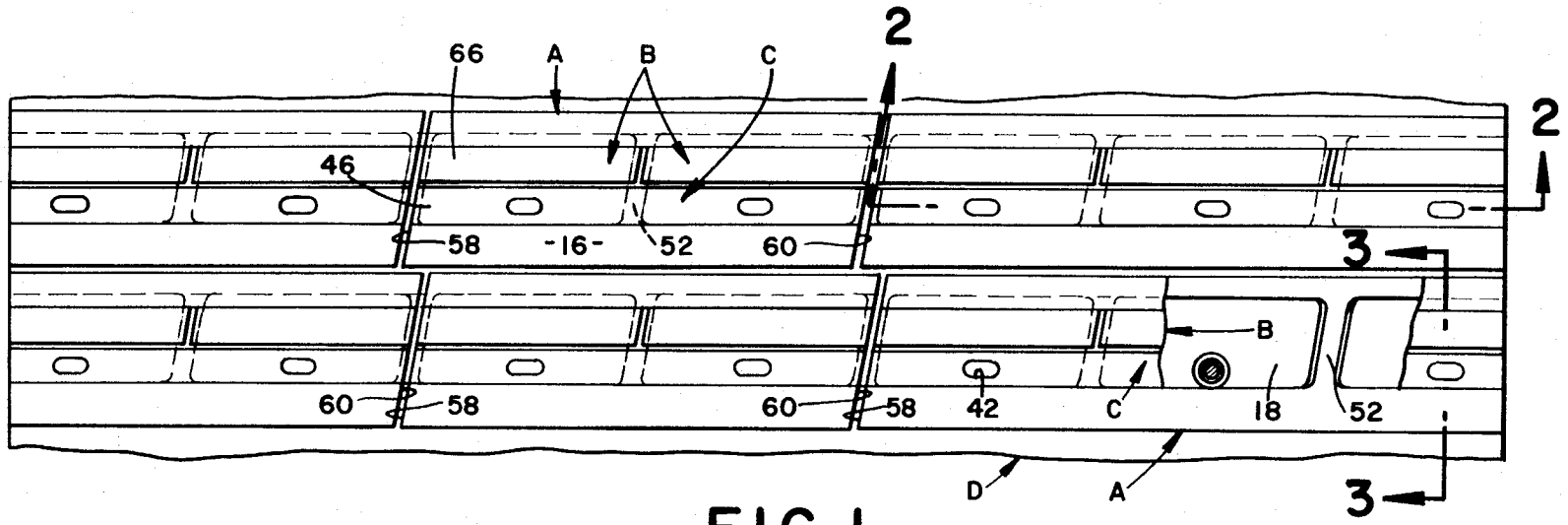
FIG. 1 is a plan view of several liner assemblies secured to a grinding mill shell according to the present invention with portions broken away to show the structural features involved.

Referring now to the drawings, wherein the showings are for purposes of illustrating preferred and alternative embodiments of the invention only and not for purposes of limiting same, FIG. 1 shows the subject new liner assembly which includes a holder segment A, a wear insert B, and a wedge member C. The liner assembly is secured to a shell D of a grinding mill. While the liner assembly is primarily designed for and will hereinafter be described as being used on the interior shell of the grinding mill, it will be appreciated that the overall inventive concept involved could be adapted for use in other environments.

Figure 3:
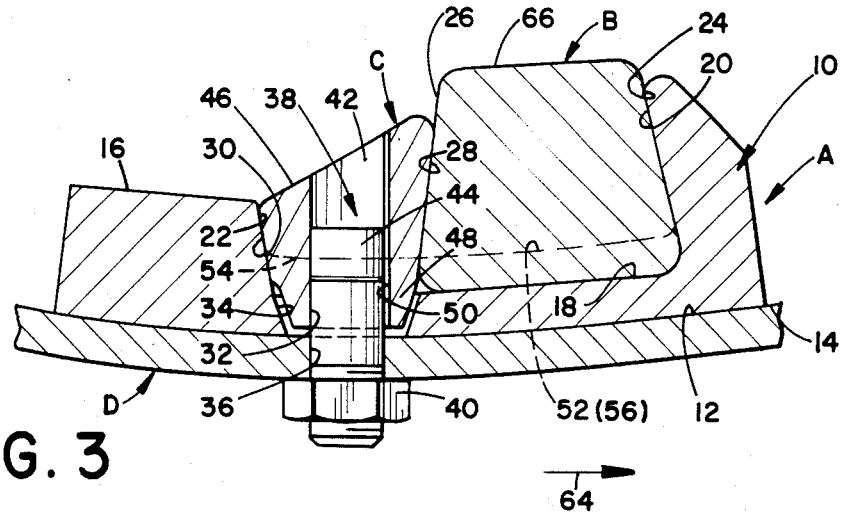
FIG. 3 is a cross-sectional view taken along lines 3—3 of FIG. 1.

More particularly, and with reference to FIG. 3, the liner assembly includes a holder body 10 of the holder segment A with the body having a first or outer surface 12 which is positioned adjacent to an inner surface 14 of the shell D. A second or inner holder surface 16 faces toward the center of the shell D. Located in the holder second surface 16 is a channel 18 having first and second longitudinally extending walls 20,22. The wear insert B is positioned within the channel 18 such that a first wear insert longitudinal wall 24 lies adjacent to the first channel wall 20. As is evident from FIG. 3, the wear insert is substantially trapezoidal in transverse cross-section such that a second longitudinal wear insert wall 26 is transversely tapered toward the first wear insert longitudinal wall 24.

Also provided in the liner assembly is the wedge member C which has a first longitudinal wall 28 which lies adjacent to the second longitudinal wall 26 of the wear insert B. A second wedge member longitudinal wall 30 lies adjacent to the second channel wall 22 of the holder A. As is evident from FIG. 3, the wedge member is also trapezoidally shaped such that the two wedge member longitudinal walls 28,30 are transversely tapered. However, the wedge member wall taper is oppositely oriented to the wear insert wall taper. When the wedge member C is secured in the holder A, the wedge member first longitudinal wall 28 abuts the wear insert second longitudinal wall 26 in a wedging relationship. The wear insert B is, thus, wedged between the first channel wall 20 and the first wedge member longitudinal wall 28.

A transverse aperture 32 is provided through the wedge member C. The wedge member aperture 32 is aligned with a transverse aperture 34 extending through the holder A as well as with a transverse aperture 36 extending through the shell D. A conventional bolt 38 is adapted to extend through the three aligned apertures 32,34,36, and a conventional nut 40 may be threaded onto the bolt 38 to secure the bolt in place. Preferably, a countersunk bore 42 (FIG. 4) is provided in the wedge member C so that a head portion 44 of the bolt does not extend past an upper wall 46 of the wedge member. Of course, other conventional types of fasteners could also be used.

Figure 4:
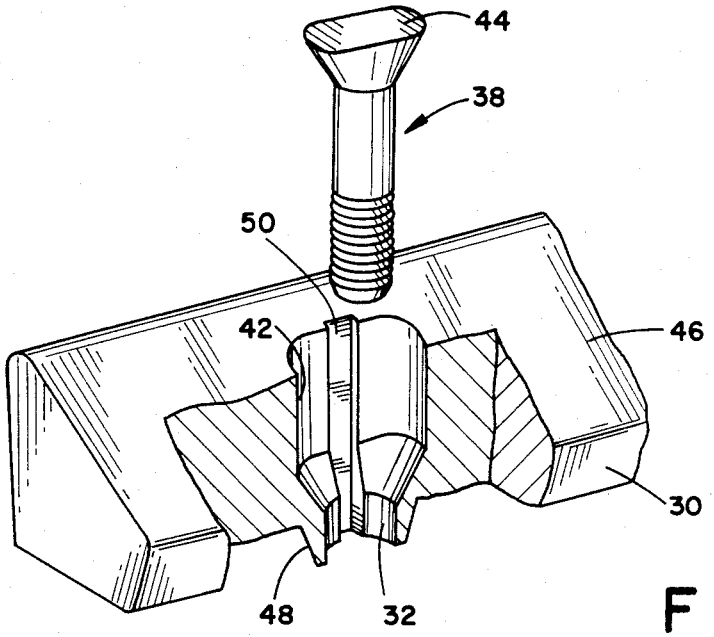
FIG. 4 is an exploded perspective view of a wedge member and a securing bolt formed according to the invention with portions broken away for clarity; and, FIG. 5 is a cross-sectional view similar to FIG. 3 for showing an alternative embodiment of a liner assembly.

The wedge member C shown in FIG. 4 is also provided with an outwardly extending annular portion or boss 48 which extends around the wedge member aperture 32. This annular portion or boss 48 is adapted to fit into the holder aperture 34 to prevent movement of the wedge member with respect to the holder segment. A slot 50 is also provided in the wedge member C and extends axially along one side of the aperture 32 and bore 42 of the wedge member.

Figure 2:
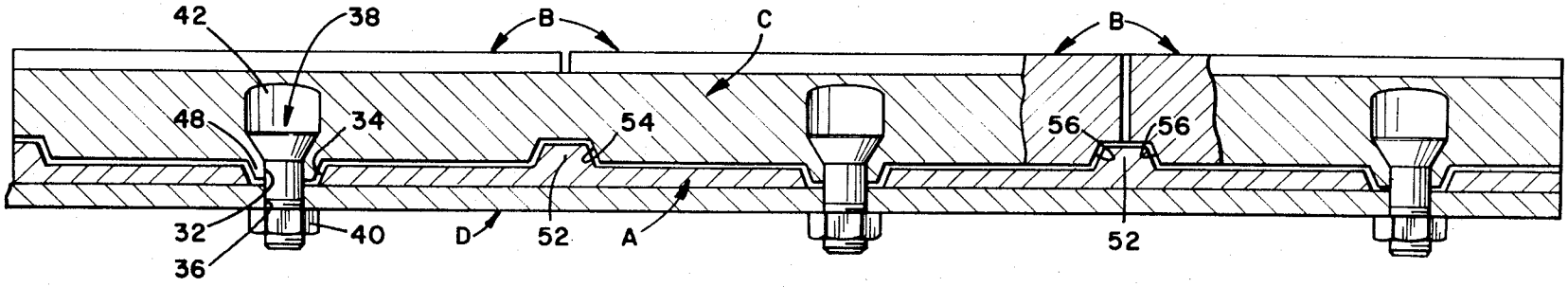
FIG. 2 is a cross-sectional view taken along lines 2—2 of FIG. 1.

With reference now to FIG. 2, a plurality of ridges 52 are preferably provided in the holder A. These ridges 52 are positioned transversely across the channel 18 as may be seen in the broken away section of FIG. 1 and as shown in dashed outline in FIG. 3. A plurality of recesses 54 are provided in the wedge member C with the recesses corresponding with the ridges 52. These ridges 52 and recesses 54 cooperate and serve to restrain the wedge member C against longitudinal movement with respect to the holder segment A.

Similar, corresponding recesses 56 may also be provided in the wear insert B. These recesses 56 also cooperate with the ridges 52 of the holder segment A to restrain the wear insert B against longitudinal movement with respect to the holder segment. The recesses 56 are preferably provided only at the ends of the wear insert B. As is evident from FIG. 2, the recesses 56 of adjacent ends of two wear inserts B are suitably conformed so as to cooperatively enclose one holder segment ridge or rib 52.

The holder segments A are provided with first and second end walls 58,60 and, as may be seen from FIG. 1, the end walls of two holder segments are adjacent to each other so that a plurality of holder segments A can be positioned around the interior periphery of the shell D. As is evident from FIG. 1, various lengths of holder segments A may be provided. In the preferred embodiment, either two or three wear inserts B are wedgingly secured in alignment by one wedge member C in each holder segment A. Preferably, the holder segment A is provided with a canted outer sidewall 62 which extends toward the rotational axis of the shell as exemplified by arrow 64 in FIG. 3.

In the preferred embodiment, the holder segments A are formed from a tough, impact resistant material which is difficult to break and is capable of retaining the wear inserts B throughout their wear life. One preferred material for the holder segments may be chrome molybdenum steel. However, it should be recognized that other conventional materials may also be used for the holder segments. The wear segments B are formed from a material which is highly resistant to abrasion. Several materials are suitable for this purpose, however, martensitic iron is the preferred material. It should be recognized, however, that martensitic steel or other material which is highly resistant to abrasion may also be used. The wedge members C may be manufactured from a tough and impact resistant material such as chrome molybdenum steel. An alternative material for the construction of wedge members C would be martensitic steel.

As constructed, the holder segments A are initially installed with the wear insert B and wedge member C already in place. The nut and bolt assemblies 38,40 are then passed through the aligned apertures 32,34,36 in the wedge member C, the holder segment A, and the shell D to secure the holder segment and, hence, the wear insert and the wedge member with respect to the shell D.

As assembled, a top wall 66 of the wear insert extends above the holder canted sidewall 62 as well as the upper wall 46 of the wedge member C. This top wall 66 is exposed to substantial wear by ore fragments as they are carried upwardly by rotation of the shell D and then tumble down due to gravity. The wear inserts B bear the primary burden of ore fragment contact during the comminution process. However, since each wear insert B is formed from a highly abrasion resitant material, it wears extremely well and requires replacement far less frequently than segments formed in their entirety from materials which do not have high abrasion resistance.

If, however, replacement of either the wear insert B, the wedge member C, or the entire holder segment A is necessary, such replacement can be accomplished simply by detaching the bolt 38 from the nut 40, and then removing the entire holder segment from the shell D. Removal of the wear insert from the channel 18 in the holder segment A is easily accomplished by removal of the wedge member C first. After the wedge member C is removed, the wear inserts B can easily be lifted away from the holder segment A.

It will be appreciated that a continuous axially extending ridge of wear inserts B is defined by the end-to-end positioning of the wear inserts in the plurality of holder segments A as disclosed in FIG. 1. These holder segments A run the entire axial length of the drum D. Since the liner assembly comprises holder segments A as well as wear inserts B and wedge members C disposed in axial and circumferential rows, it will be appreciated that the comminuting surface comprises a plurality of axially extending ridges which are circumferentially spaced around the entire inner cylindrical surface of the drum D.

Figure 5:
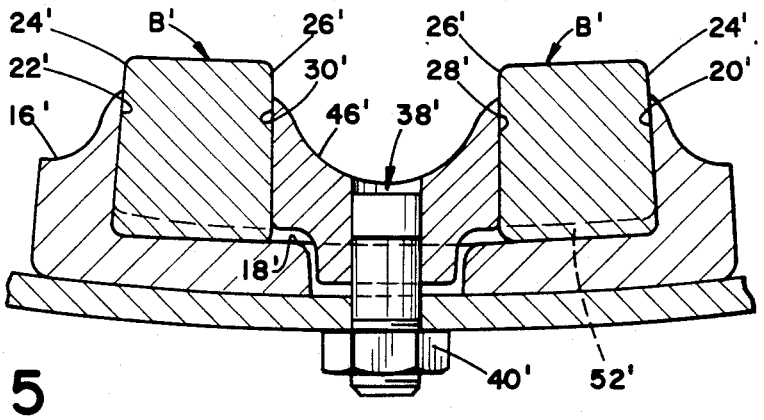

With reference now to the alternate embodiment of FIG. 5, the arrangement there shown is provided with a pair of side-by-side wear inserts. For ease of illustration and appreciation of this alternative, like components are identified by like numerals with a primed (′) suffix, and new components are identified by new numerals.

In FIG. 5, the holder segment A′ is provided with a wide channel 18′ which is suitably configured to receive a pair of wear inserts B′, B′ in a laterally spaced relationship and a wedge member C′ positioned therebetween. More specifically, the two longitudinal holder channel walls 20′,22′ are angled toward each other while the wedge member two longitudinal walls 28′,30′ are angled away from each other to wedge the two trapezoidally shaped wear members E, F in place.

Preferably, longitudinal walls 24′,26′, of each wear insert are angled toward each other by approximately seven degrees (7°). The wear inserts in this embodiment may be approximately three inches in width and may extend approximately an inch above the inner holder surface 16′ and the top wall 46′ of the wear segment. As with the preferred embodiment, suitable bolts 38′ and nuts 40' secure the assembly to a shell D'. One or more suitable ridges 52' may also be provided in the holder channel 18' to secure the wear inserts B' and wedge member C'.

The invention has been described with reference to preferred and alternative embodiments. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A liner assembly for the interior shell of a rotating grinding mill adapted to use balls, rods, rocks or the ore itself as the grinding media, the shell having a plurality of apertures and an axis of rotation, comprising:

a plurality of longitudinal holder segments having first and second ends, each segment defining a mounting surface constructed for mounting engagement with the inner surface of the shell;

a longitudinal channel being defined in each segment;

a plurality of mounting apertures being provided in each longitudinal channel for alignment with the shell apertures, respectively;

a plurality of longitudinally extending first wear inserts having a greater abrasion resistance than said holder segments, a plurality of said wear inserts adapted to be radially positioned in each of said channels of of said holder segments;

a plurality of longitudinally extending wedge members adapted to be positioned radially in said channel of each of said holder segments, a plurality of mounting apertures being provided in said wedge members, said wedge member mounting apertures being aligned with said holder segment mounting apertures and the shell apertures, and wherein said longitudinal faces of said holder segment channels, said wear inserts, and said wedge members are so configured when assembled as to wedge said wear members in said channels and prevent radial withdrawal of said wear member from their channels; and, a plurality of fastening means, each passing radially through said aligned mounting apertures of said wedge members, said holder segments and the shell apertures, for being the sole fastening of each of said holder segments directly to the shell and being, through the wedging of said wedge members, the sole fastening of said wear inserts in said channel;

whereby wear inserts may be removed by removing only the associated wedge members and fastening means without removing any other wedge members or fastening means and without removing any holder segment.

2. The liner assembly of claim 1 wherein one of said wedge members and holder segment is provided with an outwardly extending annular portion surrounding one of said wedge members apertures and holder segment mounting apertures, each said annular portion fitting into an associated one of the other of said wedge members apertures and holder segment mounting apertures to secure said wedge members against movement with respect to said holder segment.

3. The liner assembly of claim 1 wherein one of said holder segment and wedge members is provided with a plurality of transverse ribs and the other of said holder segment and wedge members is provided with corresponding recesses to restrain said wedge members against longitudinal movement with respect to said holder segment.

4. The liner assembly of claim 1 wherein one of said holder segment and wear insert is provided with a plurality of transverse ribs and the other of said holder segment and wear insert is provided with corresponding recesses to restrain said wear insert against longitudinal movement with respect to said holder segment.

5. The liner assembly of claim 4 wherein said recesses are provided only at the ends of said wear insert, and wherein said recesses of adjacent ends of adjacent wear inserts are suitably conformed to enclose one rib on said holder segment.

6. The liner assembly of claim 1 wherein a first longitudinal wall of said holder segment is angled toward a second longitudinal wall of said holder segment and wherein said wedge members has a first and a second longitudinal face, said first wedge longitudinal face being angled toward said first holder segment longitudinal wall and said second wedge longitudinal face being angled toward said second holder segment longitudinal wall.

7. The liner assembly of claim 1 wherein a plurality of liner assemblies are arranged in axial rows such that a plurality of holder segments and wear inserts are configured to define axially extending elevated ridges.

8. The liner assembly of claim 1 wherein said wedge members is positioned between said first and second wear inserts to wedgingly retain both wear inserts in place.

9. The liner assembly of claim 1 further comprising:

a plurality of spaced transverse ribs which are provided in said longitudinally extending channel of each of said holder segments;

a plurality of spaced transverse recesses which are provided in each of said longitudinally extending wear inserts;

a plurality of spaced transverse recesses which are provided in each of said longitudinally extending wedge members; and, wherein said transverse ribs of each holder segment are aligned with said recesses of each wear insert and wedge member to restrain said wear insert and wedge member against longitudinal movement when said wear insert and wedge member are positioned in said holder segment channel.

10. The liner assembly of claim 1 further including a plurality of second wear inserts with said first and second wear inserts being positioned in laterally spaced relation against respective longitudinal walls of a holder segment channel and wherein said wedge members are positioned intermediate said first and second wear inserts to wedgingly engage same.

* * * * *

UNITED STATES PATENT AND TRADEMARK OFFICE

CERTIFICATE OF CORRECTION

PATENT NO. : 4,906,158

DATED : March 6, 1990

INVENTOR(S) : Joseph H. Jewitt et al.

It is certified that error appears in the above-identified patent and that said Letters Patent is hereby corrected as shown below:

On the title page, item [19] and [75]:

Change the name of the inventor from "Dewitt" to --Jewitt--;

Col. 2, line 58, change "&hat" to --that--;

Col. 3, line 35, change "closedup" to --closed-up--;

line 13, change "." at the end of line to --,--;

Col. 4, line 14, change "&o" to --to--;

Col. 6, line 64, after the word "distance" insert --.--;

Col. 8, line 20, change the word "precurl" to --pre-curl--;

Signed and Sealed this

Fifth Day of November, 1991

*Attest:*

HARRY F. MANBECK, JR.

*Attesting Officer*

*Commissioner of Patents and Trademarks*